US011835187B2

(12) United States Patent
Zhong et al.

(10) Patent No.: US 11,835,187 B2
(45) Date of Patent: Dec. 5, 2023

(54) MULTI-MODE HUNTING LAMP

(71) Applicant: Ningbo Taller Intelligent Technology Co., Ltd, Yuyao (CN)

(72) Inventors: Tazhu Zhong, Yuyao (CN); Xiang Zhang, Yuyao (CN)

(73) Assignee: NINGBO TALLER INTELLIGENT TECHNOLOGY CO., LTD, Yuyao (CN)

( * ) Notice: Subject to any disclaimer, the term of this patent is extended or adjusted under 35 U.S.C. 154(b) by 0 days.

(21) Appl. No.: 17/813,754

(22) Filed: Jul. 20, 2022

(65) Prior Publication Data

US 2023/0228388 A1 Jul. 20, 2023

(30) Foreign Application Priority Data

Jan. 19, 2022 (CN) ..... 202210065429.3

(51) Int. Cl.

| | |
|---|---|
| ***F21L 4/04*** | (2006.01) |
| ***F21V 21/08*** | (2006.01) |
| ***F21V 23/00*** | (2015.01) |
| ***F21V 23/04*** | (2006.01) |
| ***F21Y 115/10*** | (2016.01) |

(52) U.S. Cl.

CPC ..... *F21L 4/04* (2013.01); *F21V 21/0816* (2013.01); *F21V 23/003* (2013.01); *F21V 23/0428* (2013.01); *F21Y 2115/10* (2016.08)

(58) Field of Classification Search

CPC ..... F21L 4/04; F21V 21/0816; F21V 23/003; F21V 23/0428

See application file for complete search history.

(56) References Cited

U.S. PATENT DOCUMENTS

| | | | | |
|---|---|---|---|---|
| 4,984,724 | A * | 1/1991 | Johnston | F21V 21/0816 362/108 |
| 6,260,985 | B1 * | 7/2001 | Zeller | F21V 27/00 362/208 |
| 2002/0067246 | A1 * | 6/2002 | Woitscholl | F21V 21/406 340/331 |
| 2006/0028812 | A1 * | 2/2006 | Yuen | F21V 21/406 362/183 |
| 2008/0002395 | A1 * | 1/2008 | Eisenberg | F41H 13/0087 362/296.07 |

(Continued)

FOREIGN PATENT DOCUMENTS

| | | |
|---|---|---|
| CN | 201772277 U | 3/2011 |
| CN | 203560821 U | 4/2014 |
| CN | 212005314 U | 11/2020 |

*Primary Examiner* — Bryon T Gyllstrom

(74) *Attorney, Agent, or Firm* — INNOVATION CAPITAL LAW GROUP, LLP; Vic Lin

(57) ABSTRACT

A multi-mode hunting lamp, comprising: a housing with a receiving chamber, a handle and a first hinge part being arranged on the housing; a lamp base provided with a second hinge part, the second hinge part being hinged to the first hinge part so that an illumination angle of the lamp base can be adjusted, and a plurality of LED lights being arranged in the lamp base; and a control module arranged in the receiving chamber and electrically connected to the LED lights. The hunting lamp has a spotlight mode, a floodlight mode and a warning light mode, and the control module can control the hunting lamp to switch among the spotlight mode, the floodlight mode and the warning light mode.

9 Claims, 13 Drawing Sheets

(56) References Cited

U.S. PATENT DOCUMENTS

| | | | | |
|---|---|---|---|---|
| 2008/0278938 | A1* | 11/2008 | Wu | B26B 11/008 362/206 |
| 2014/0218899 | A1* | 8/2014 | Kam Law | F21S 8/04 362/183 |
| 2017/0234525 | A1* | 8/2017 | Cate | B60Q 1/00 362/190 |

* cited by examiner

MULTI-MODE HUNTING LAMP

BACKGROUND OF THE INVENTION

1. Technical Field

The invention relates to the technical field of lamps, in particular to a multi-mode hunting lamp.

2. Description of Related Art

Many animals sleep during the day and go out to look for food at night, so people often hunt at night, which requires hunting lamps. Hunting lamps not only have a lighting function, but also help hunters find prey. Some animals, like frogs, basically lose their visual senses under strong light because their visual nervous system cannot capture the images of moving objects, thus being unable to move under this condition. Hunting lamps are very helpful in hunting prey of such kind.

Existing hunting lamps only have a basic hunting lighting function, but cannot help with emergency situations during hunting, and are often left idle due to the limited function.

BRIEF SUMMARY OF THE INVENTION

In view of the above shortcomings in the prior art, the technical problem to be solved by the invention is to provide a hunting lamp with multi-mode switching, convenient to use and high in safety. According to the technical scheme adopted by the invention to solve the technical problems, a multi-mode hunting lamp comprises:

- a housing with a receiving chamber, the housing being provided with a handle and a first hinge part;
- a lamp base provided with a second hinge part, the second hinge part being hinged to the first hinge part so that a lighting angle of the lamp base can be adjusted, and a plurality of LED lights being arranged in the lamp base; and
- a control module arranged in the receiving chamber and electrically connected to the LED lights;
- wherein the hunting lamp has a spotlight mode, a floodlight mode and a warning light mode, and the control module can control the hunting lamp to switch among the spotlight mode, the floodlight mode and the warning light mode.

Further, the plurality of LED lights comprise spotlight LED beads, floodlight LED beads and warning light LED beads, which are all electrically connected to the control module;

- the control module comprises a key switch circuit, a main control chip and a lamp panel drive circuit, and the key switch circuit is configured to output a switch signal to the main control chip according to the opening and closing of keys;
- the main control chip is configured to output a corresponding light control signal to the lamp panel drive circuit according to the received switch signal;
- the lamp panel drive circuit is configured to adjust a lighting mode of the LED lights according to the light control signal;
- when the hunting lamp is switched to the spotlight mode, the spotlight LED beads light up; when the hunting lamp is switched to the floodlight mode, the floodlight LED beads light up; and when the hunting lamp is switched to the warning light mode, the warning light LED beads flash.

Further, the light control signal may be a first light control signal, a second light control signal or a third light control signal, the first light control signal is used to control the spotlight mode, the second light control signal is used to control the floodlight mode, and the third light control signal is used to control the warning light mode.

Further, the main control chip comprises a first pin to a twentieth pin, and the key switch circuit comprises:

- a first key switch, one end of the first key switch being grounded through a forty-sixth resistor, and the other end being connected to the eleventh pin of the main control chip; and
- a first socket connector comprising a first socket to a third socket, the first socket being connected to the fifteenth pin of the main control chip, the second socket being connected to the fourteenth pin of the main control chip, and the third socket being grounded through the forty-sixth resistor.

Further, the lamp panel drive circuit comprises a first digital-to-analog conversion chip and a second digital-to-analog conversion chip, the first digital-to-analog conversion chip and the second digital-to-analog conversion chip each comprise a first pin to an eighth pin, and the LED lights comprise a first socket to a fourth socket;

- the fourth pin of the first digital-to-analog conversion chip is connected to the first light control signal output by the nineteenth pin of the main control chip through a forty-second resistor, and is grounded through a forty-third resistor and a forty-seventh resistor connected in sequence, the first pin to the third pin of the first digital-to-analog conversion chip are grounded through the forty-seventh resistor, and the fifth pin to the eighth pin of the first digital-to-analog conversion chip are connected to the third socket of the LED lights through a thirty-fifth resistor;
- the fourth pin of the second digital-to-analog conversion chip is connected to the second light control signal output by the twentieth pin of the main control chip through a fortieth resistor, and is grounded through a forty-fourth resistor and the forty-seventh resistor connected in sequence, the first pin to the third pin of the second digital-to-analog conversion chip are grounded through the forty-seventh resistor, and the fifth pin to the eighth pin of the second digital-to-analog conversion chip are connected to the second socket of the LED lights; and
- the fourth socket of the LED lights is connected to a working power supply, the first socket of the LED lights is connected to a drain of a first field effect transistor (FET), a source of the first FET is grounded, a gate of the first FET is connected to one end of a thirty-ninth resistor and one end of a forty-first resistor, the other end of the thirty-ninth resistor is connected to the tenth pin of the main control chip, the other end of the forty-first resistor is grounded and connected to the first pin of the main control chip and one end of a twenty-fifth capacitor through a forty-fifth resistor, and the other end of the twenty-fifth capacitor is grounded.

Further, the second hinge part extends from a top of the lamp base towards the housing, a through hole is formed in the second hinge part, the first hinge part is arranged at the top of the housing, the first hinge part is provided with an installation groove in which a rotating shaft is arranged, the second hinge part is arranged in the installation groove, and the rotating shaft penetrates through the through hole; and two fixture blocks are arranged on the housing along two sides of the second hinge part respectively, and the second hinge part is rotatably arranged between the two fixture blocks.

Further, a bottom of the housing is provided with a first placement part, an end of the housing away from the lamp base is provided with a second placement part, and the hunting lamp can be placed in a horizontal state or a vertical state;

when the hunting lamp is placed in the horizontal state, the first placement part supports the whole hunting lamp; and when the hunting lamp is placed in the vertical state, the second placement part supports the whole hunting lamp.

Further, a circular flange is arranged on the bottom of the housing in a downward protruding mode, the first placement part is arranged on the flange in a protruding mode, an end cap is arranged at an end of the housing away from the lamp base, the second placement part is arranged at an end of the end cap away from the lamp base along its own circumference in a protruding mode, and the second placement part is perpendicular to the first placement part.

Further, the multi-mode hunting lamp comprises a strap, one end of the strap is connected to a first loop, the other end of the strap is connected to a second loop, the first loop is rotatably connected to the lamp base, and the second loop is rotatably connected to a rear end of the housing.

Further, the first loop and the second loop each comprise a first hinge arm, a second hinge arm and a joint arm, the first hinge arm and the second hinge arm are spaced apart, the joint arm is connected to one end of the first hinge arm and one end of the second hinge arm, and the other end of the first hinge arm and the other end of the second hinge arm are hinged to the housing or the lamp base.

Compared with the prior art, the invention has at least the following beneficial effects.

According to the invention, the hunting lamp can switch among the spotlight mode, the floodlight mode and the warning light mode. The spotlight mode can be adopted during outdoor hunting, because concentrated light and long irradiation distance can help find prey. The warning light mode can be adopted in case of an emergency during hunting, so as to warn others and send out a distress signal. The floodlight mode can be adopted for indoor lighting, so as to provide a wide range of even light irradiation. The multiple modes allow the hunting lamp to be used for indoor lighting and emergency calling besides hunting, so as to reduce the idle rate of the hunting lamp. In addition, the first placement part is arranged on the bottom of the housing and the second placement part is arranged at the rear of the housing, both of which can support the whole hunting lamp stably, so that the hunting lamp can be used both horizontally and vertically. Further, an angle of the lamp base relative to the housing is adjustable, which allows an irradiation angle to be adjusted by rotating the lamp base even after the hunting lamp is well placed, so that the irradiation angle of the hunting lamp can be adjusted in multiple ways. The handle is arranged on the housing, and the strap is connected between the housing and the lamp base, so that users can carry the hunting lamp in the hand, on the arm or on the shoulders, which is convenient.

According to the invention, the key switch circuit in the control module outputs the switch signal to the main control chip according to the opening and closing conditions of the switch; after receiving the signal, the main control chip outputs the corresponding light control signal to the lamp panel drive circuit; and the lamp panel drive circuit adjusts the lighting mode of the LED lights according to the received light control signal, which allows the hunting lamp to be easily controlled to switch among the spotlight mode, the floodlight mode and the warning light mode.

BRIEF DESCRIPTION OF THE SEVERAL VIEWS OF THE DRAWINGS

FIG. 3 is a structural diagram of a hunting lamp placed in a vertical state;

In the drawings:

Figure 1:
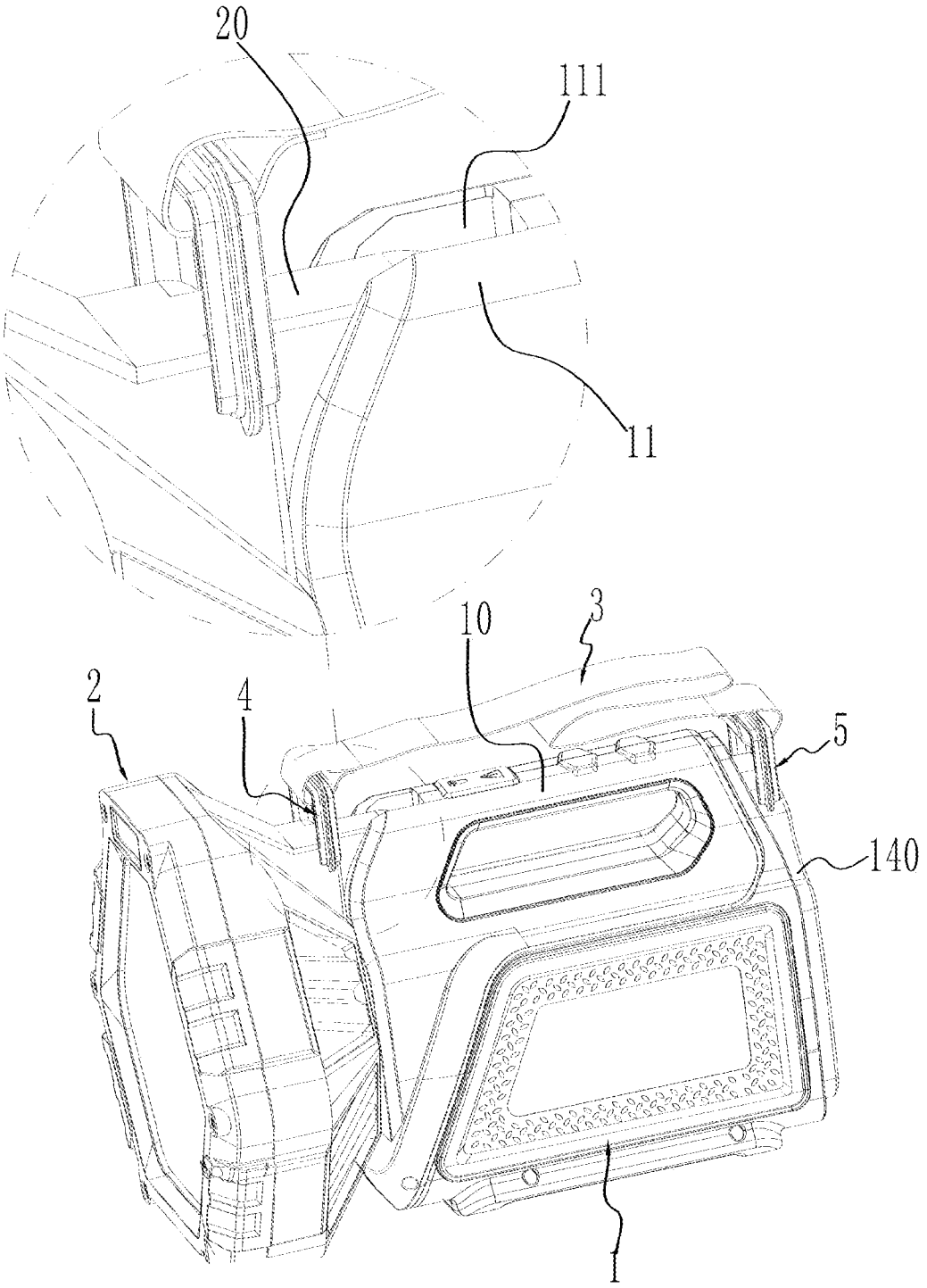
FIG. 1 is a structural diagram of a hunting lamp according to the invention.

1. housing; 10. handle; 11. first hinge part; 12. fixture block; 13. first placement part; 14. second placement part; 111. installation groove; 112. rotating shaft; 130. flange; 140. end cap;

2. lamp base; 20. second hinge part; 201. through hole; 21. LED light; 211. spotlight LED bead; 212. floodlight LED bead; 213. warning light LED bead;

3. strap;

4. first loop; 450. first hinge arm; 451. second hinge arm; 452. joint arm;

5. second loop.

DETAILED DESCRIPTION OF THE INVENTION

The following are specific embodiments of the invention and a further description of the technical scheme of the invention with reference to the drawings, but the invention is not limited to these embodiments.

It should be noted that all directional indications (such as up, down, left, right, front, back) in the embodiment of the invention are only used to explain the relative positional relationship, movement situation, etc. among components in a certain posture (as shown in the drawings), and if the specific posture changes, the directional indication will change accordingly.

In addition, terms like "first", "second", etc. in the invention are only for descriptive purposes, and cannot be understood as indicating or implying their relative importance or implicitly indicating the number of indicated technical features. Therefore, features defined with "first" and "second" can include at least one of the features explicitly or implicitly. In the description of the invention, "a plurality of" means at least two, such as two, three, etc., unless otherwise specified.

In the invention, unless otherwise specified and limited, the terms "connect" and "fix" should be broadly understood, for example, "fix" may be fixed connection, detachable connection or integration; may be mechanical connection or electrical connection; may be direct connection or indirect connection through an intermediate medium; and may be internal communication of two elements or interaction between two elements, unless otherwise explicitly limited. For those of ordinary skill in the art, the specific meanings of the above terms in the invention may be understood according to specific situations.

In addition, the technical schemes of various embodiments of the invention can be combined, on the premise that it can be realized by those of ordinary skill in the art. When the combination of technical schemes is contradictory or infeasible, it should be considered that such combination of technical schemes does not exist and is not within the scope of protection required by the invention.

Figure 2:
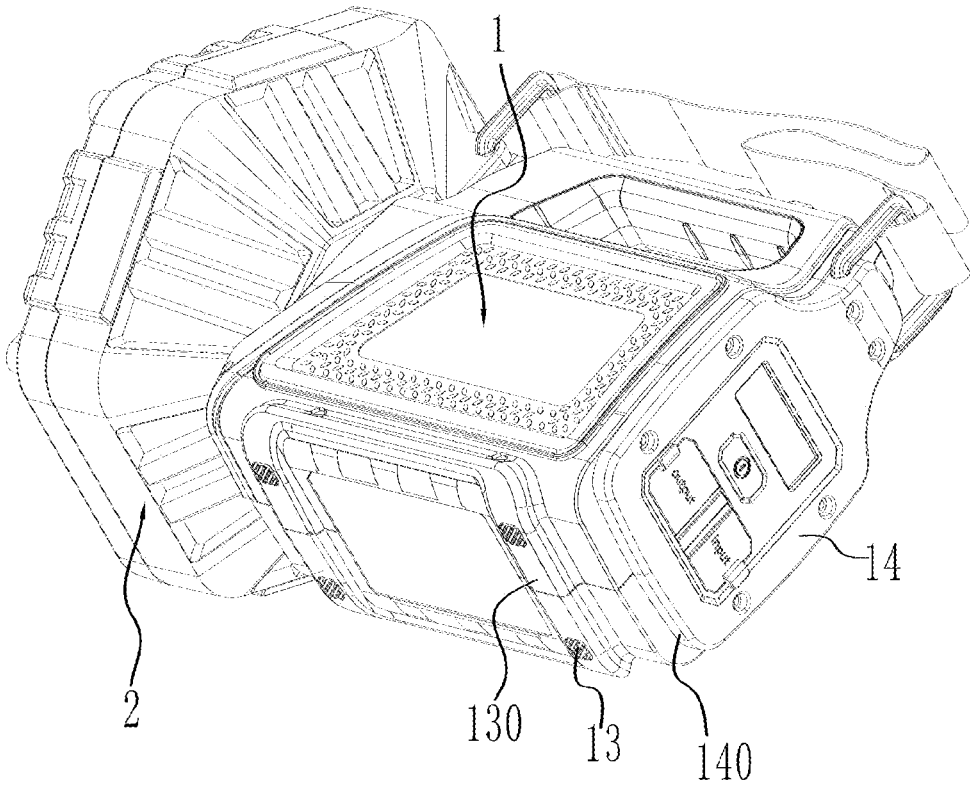
FIG. 2 is a structural diagram of FIG. 1 from another perspective.
Figure 3:
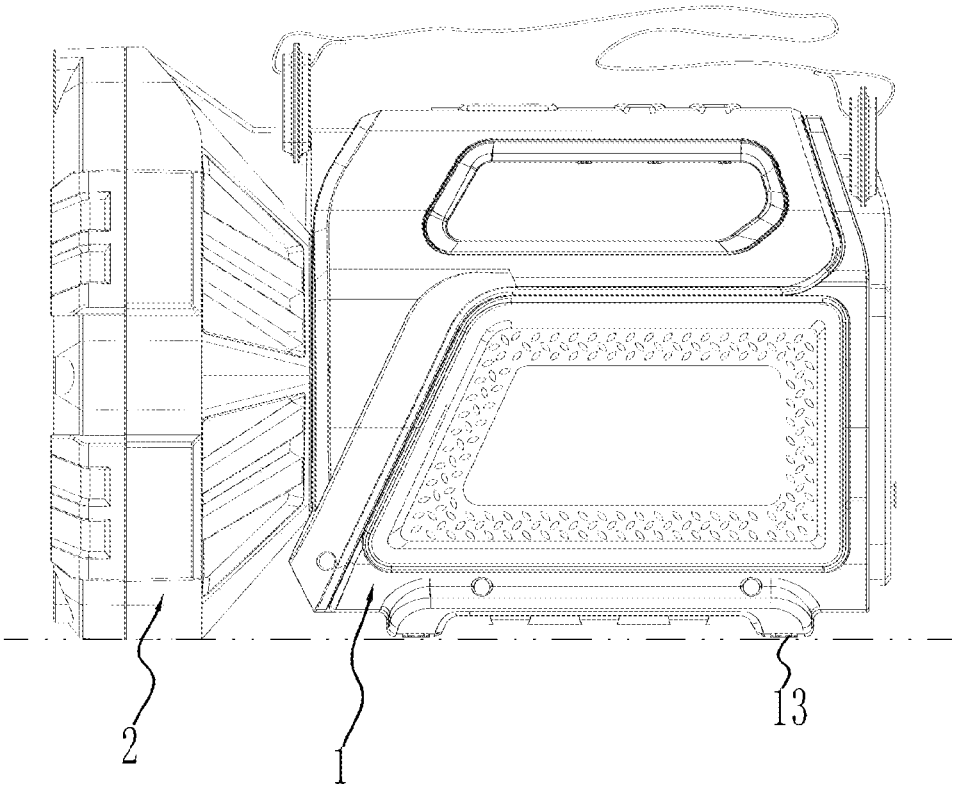
FIG. 3 is a structural diagram of a hunting lamp placed in a horizontal state.
Figure 4:
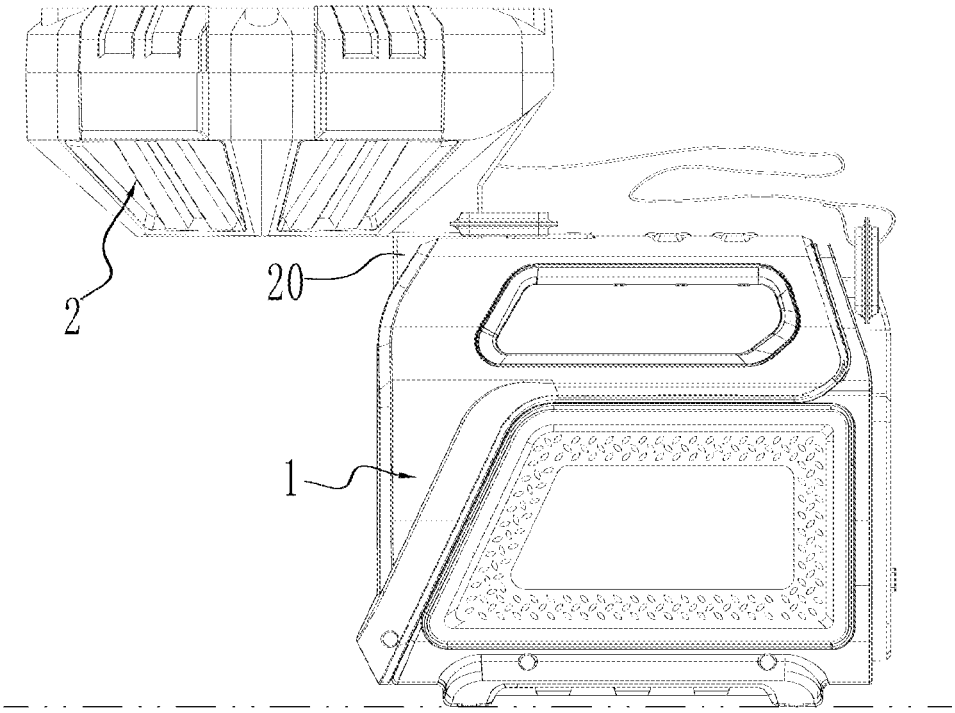
FIG. 4 is a structural diagram after a lamp base in FIG. 3 is rotated 90 degrees upwards.
Figure 5:
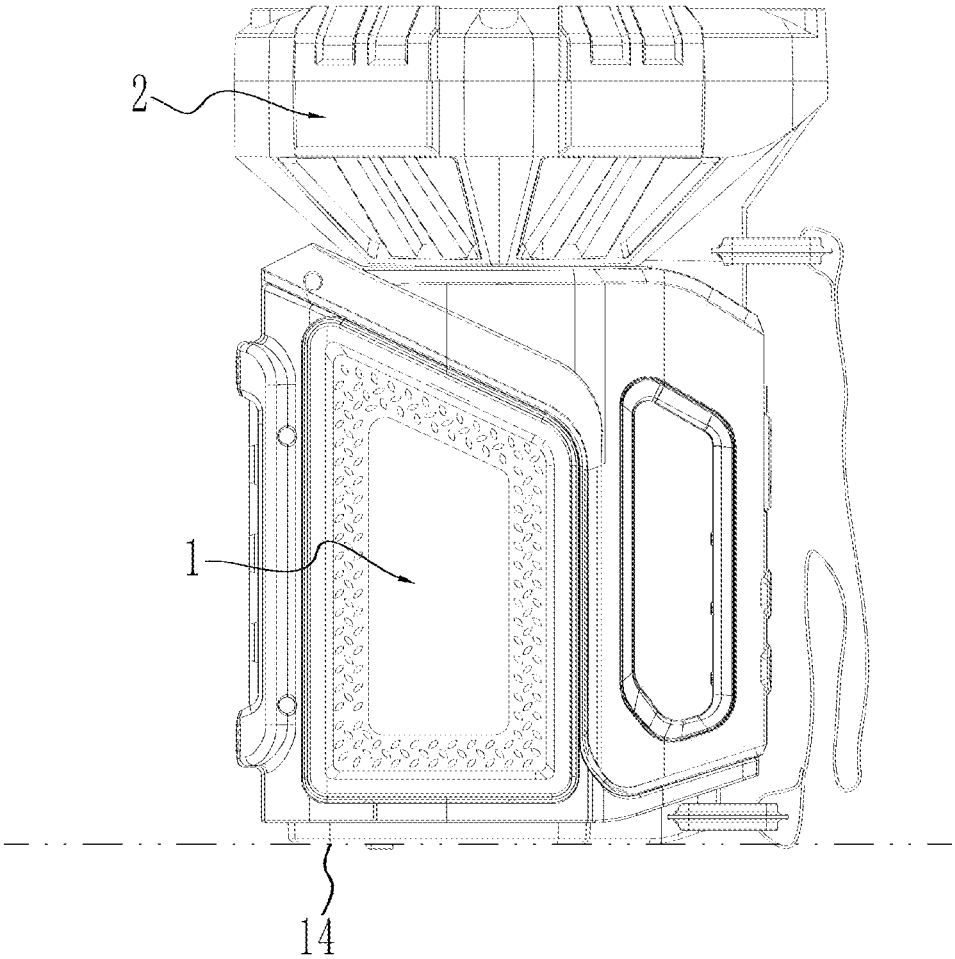
Figure 6:
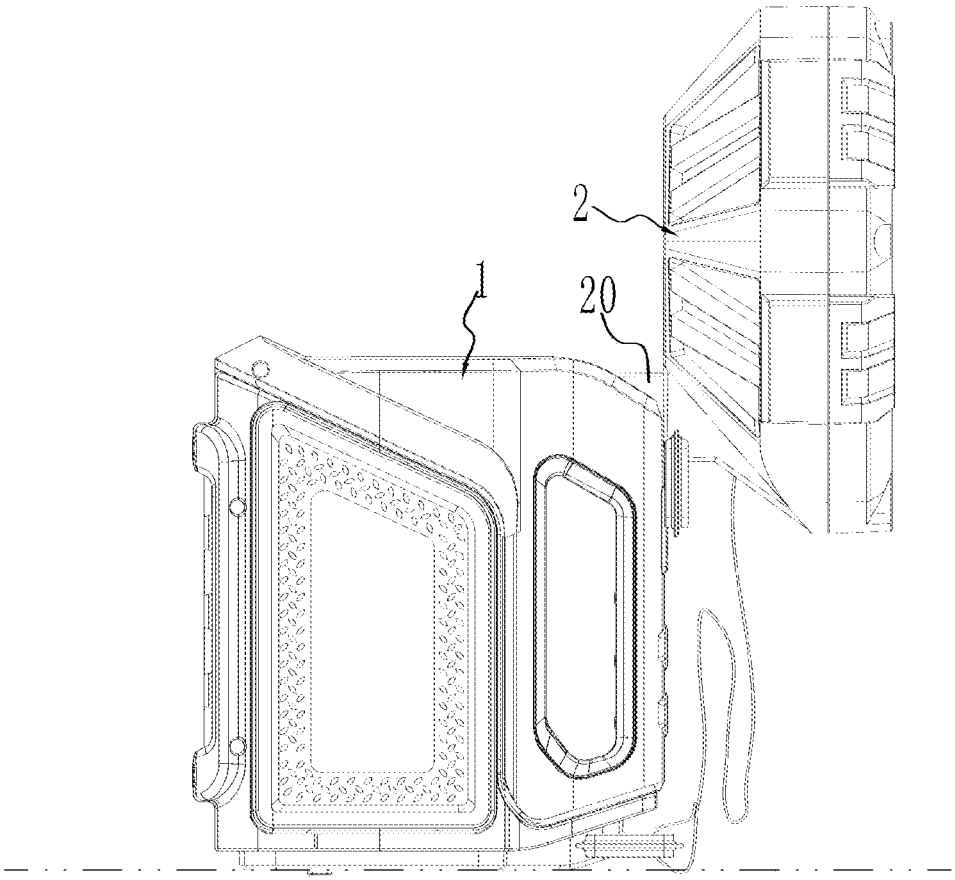
FIG. 6 is a structural diagram after a lamp base in FIG. 3 is rotated 90 degrees to the right.

As shown in FIGS. 1-2, a multi-mode hunting lamp comprises: a housing 1 with a receiving chamber, wherein a handle 10 and a first hinge part 11 are arranged on the housing 1, and the whole hunting lamp can be lifted to be used by holding the handle 10; a lamp base 2 provided with a second hinge part 20, wherein the second hinge part 20 is hinged to the first hinge part 11 so that an illumination angle of the lamp base 2 can be adjusted, a plurality of LED lights 21 are arranged in the lamp base 2, an irradiation direction of the hunting lamp can be directly and integrally adjusted when the hunting lamp is lifted to be used, and an irradiation angle can be adjusted by rotating the lamp base 2 after the position of the hunting lamp is fixed, which is convenient and can realize a wide irradiation range; and a control module (not labeled in the figure) arranged in the receiving chamber and electrically connected to the LED lights 21, wherein the control module can control a lighting mode of the LED lights 21 to realize the switching among multiple modes. The hunting lamp has a spotlight mode, a floodlight mode and a warning light mode, and the control module can control the hunting lamp to switch among the spotlight mode, the floodlight mode and the warning light mode.

Figure 7:
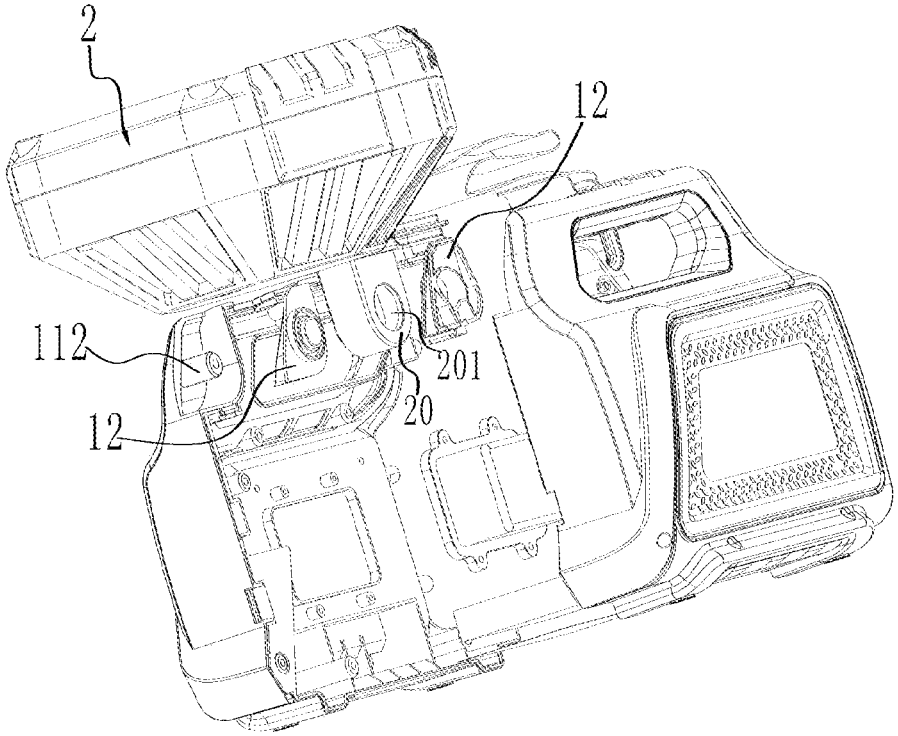
FIG. 7 is an explosive view of a hunting lamp.
Figure 8:
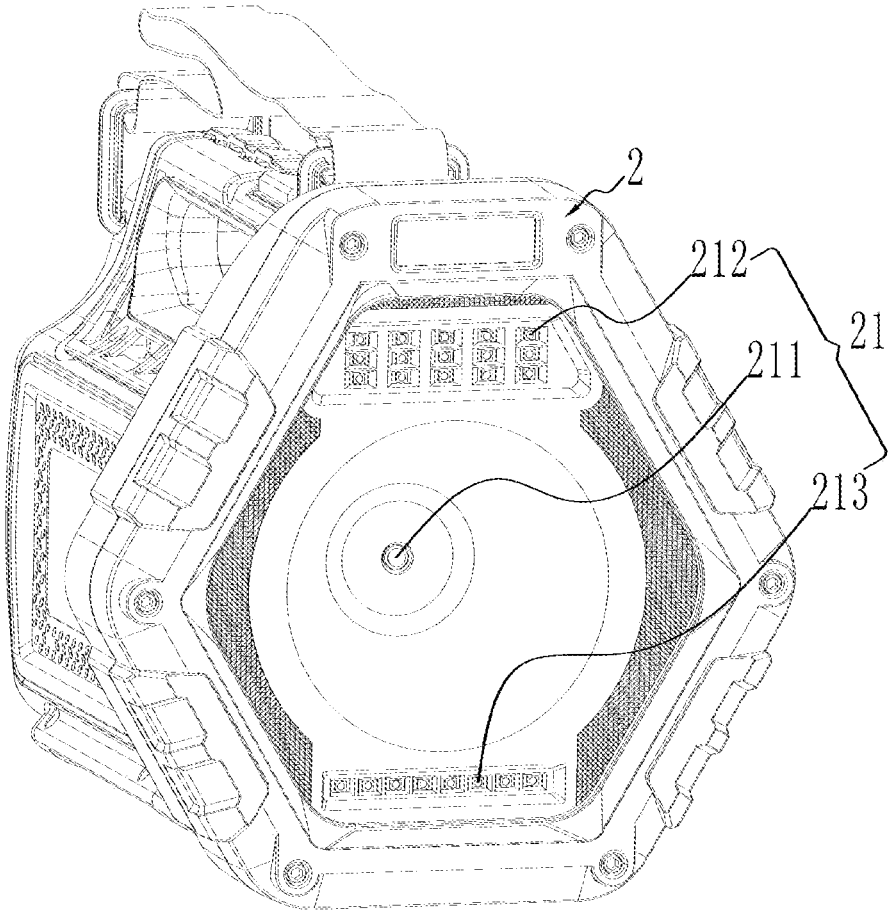
FIG. 8 is a structural diagram of a hunting lamp after a lamp base cover plate is removed.
Figure 9:
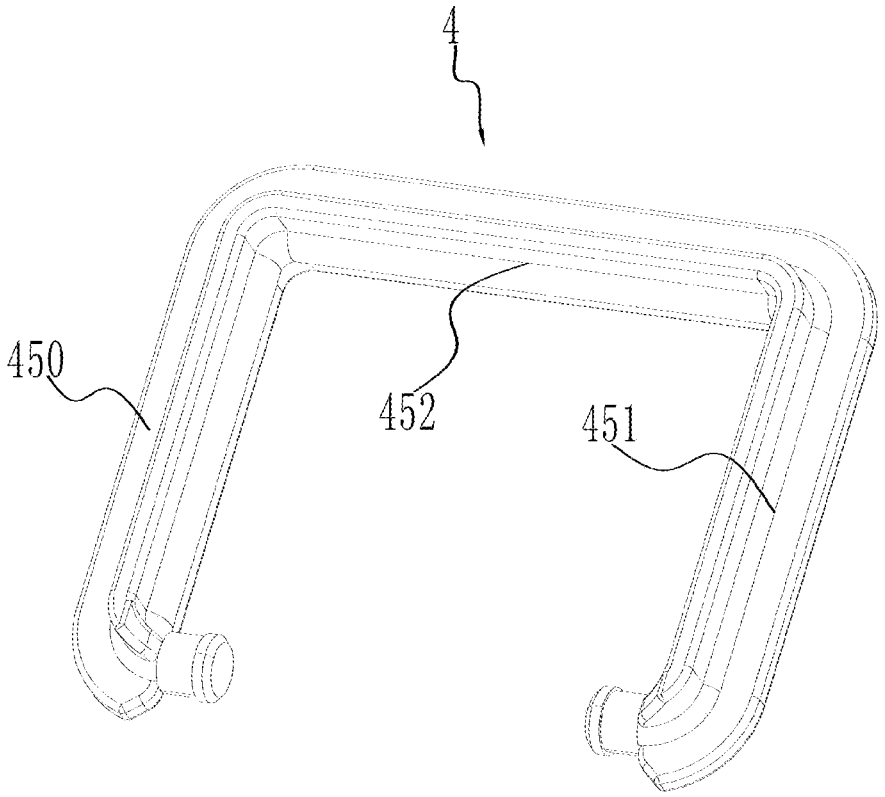
FIG. 9 is a structural diagram of a first loop.

As shown in FIGS. 1 and 7, the second hinge part 20 extends from a top of the lamp base 2 towards the housing 1, and a through hole 201 is formed in the second hinge part 20. The first hinge part 11 is arranged at a top of the housing 1, the first hinge part 11 is provided with an installation groove 111 in which a rotating shaft 112 is arranged, the second hinge part 20 is arranged in the installation groove 111, and the rotating shaft 112 penetrates through the through hole 201. The first hinge part 11 and the second hinge part are respectively arranged at the top of the housing 1 and at the top of the lamp base 2, so that the lamp base can be rotated conveniently without interference whether the hunting lamp is in a horizontal state or a vertical state. In addition, two fixture blocks 12 are arranged on the housing 1 along two sides of the second hinge part 20 respectively, and the second hinge part 20 is rotatably arranged between the two fixture blocks 12. In this way, a hinge structure between the lamp base 2 and the housing 1 forms a hinge joint, and after fixing an angle of the lamp base 2 relative to the housing 1, that is, after fixing the irradiation angle of the hunting lamp, the lamp base 2 will not automatically move relative to the housing, thus ensuring the stability of the irradiation angle. The second hinge part 20 is clamped by the two fixture blocks 12, so that a contact area can be increased, and the position reliability of the lamp base 2 can be improved. In this embodiment, the housing 1 is divided into a left housing and a right housing, which are detachably connected to form the housing 1. The left housing and the right housing are each provided with one fixture block 12, and the second hinge part 20 is located between the left housing and the right housing.

As shown in FIGS. 2-6, a bottom of the housing 1 is provided with a first placement part 13, and an end of the housing 1 away from the lamp base 2 is provided with a second placement part 14. The hunting lamp can be placed in a horizontal state or a vertical state; when the hunting lamp is placed in the horizontal state, the first placement part 13 supports the whole hunting lamp; and when the hunting lamp is placed in the vertical state, the second placement part 14 supports the whole hunting lamp. During outdoor hunting, users usually carry the hunting lamp in the hand or on the shoulders, instead of putting the hunting lamp on the ground or desktop. When the hunting lamp is used for indoor or outdoor lighting, like in an outdoor tent or a room, the hunting lamp is usually placed on the ground or desktop. The arrangement of the first placement part 13 and the second placement part 14 effectively ensures the structural stability of the hunting lamp in both horizontal and vertical states, thus ensuring the stability of the lighting angle. A circular flange 130 is arranged on the bottom of the housing 1 in a downward protruding mode, the first placement part 13 is arranged on the flange 130 in a protruding mode, an end cap 140 is arranged at an end of the housing 1 away from the lamp base 2, the second placement part 14 is arranged at an end of the end cap 140 away from the lamp base 2 along its own circumference in a protruding mode, and the second placement part 14 is perpendicular to the first placement part 13. By arranging the circular flange 130 at the bottom of the housing 1 in a protruding mode and arranging the first placement part 13 on the flange 130, a contact area between the bottom of the housing 1 and the desktop can be reduced, so as to avoid the toppling of the hunting lamp due to an uneven bottom of the housing 1. Similarly, a circle of second placement part 14 protrudes from a rear end of the housing 1, which can improve the structural stability of the hunting lamp in the vertical state.

As shown in FIGS. 1-9, the hunting lamp further comprises a strap 3, one end of the strap 3 is connected to a first loop 4, the other end of the strap 3 is connected to a second loop the first loop 4 is rotatably connected to the lamp base 2, and the second loop 5 is rotatably connected to a rear end of the housing 1.

The first loop 4 and the second loop 5 each comprise a first hinge arm 450, a second hinge arm 451 and a joint arm 452, the first hinge arm 450 and the second hinge arm 451 are spaced apart, the joint arm 452 is connected to one end of the first hinge arm 450 and one end of the second hinge arm 451, and the other end of the first hinge arm 450 and the other end of the second hinge arm 451 are hinged to the housing 1 or the lamp base 2.

The first loop 4 and the second loop 5 can rotate freely relative to the lamp base 2 and the housing 1 respectively, so that when users carry the hunting lamp in the hand or on the shoulders, the hunting lamp does not swing much, thus improving the lighting effect. As two ends of the strap 3 are indirectly connected to the lamp base 2 and the rear end of the housing 1 respectively, when users carry the hunting lamp in the hand or on the shoulders, the hunting lamp can remain balanced.

In actual use, the hunting lamp can switch among the spotlight mode, the floodlight mode and the warning light mode. The spotlight mode can be adopted during outdoor hunting, because concentrated light and long irradiation distance can help find prey. The warning light mode can be adopted in case of an emergency during hunting, so as to warn others and send out a distress signal. The floodlight mode can be adopted for indoor lighting, so as to provide a wide range of even light irradiation. The multiple modes allow the hunting lamp to be used for indoor lighting and emergency calling besides hunting, so as to reduce the idle rate of the hunting lamp. In addition, the first placement part 13 is arranged on the bottom of the housing 1 and the second placement part 14 is arranged at the rear of the housing 1, both of which can support the whole hunting lamp stably, so that the hunting lamp can be used both horizontally and vertically. Further, an angle of the lamp base 2 relative to the housing 1 is adjustable, which allows an irradiation angle to be adjusted by rotating the lamp base 2 even after the hunting lamp is well placed, so that the irradiation angle of the hunting lamp can be adjusted in multiple ways. The handle 10 is arranged on the housing 1, and the strap 3 is connected between the housing 1 and the lamp base 2, so that users can carry the hunting lamp in the hand, on the arm or on the shoulders, which is convenient.

As shown in FIG. 8 and FIGS. 10-13, the plurality of LED lights 21 in this hunting lamp comprise spotlight LED beads 211, floodlight LED beads 212 and warning light LED beads 213, all of which are electrically connected to the control module. The control module comprises a key switch circuit, a main control chip and a lamp panel drive circuit, and the key switch circuit is configured to output a switch signal to the main control chip according to the opening and closing of keys; the main control chip is configured to output a corresponding light control signal to the lamp panel drive circuit according to the received switch signal; and the lamp panel drive circuit is configured to adjust a lighting mode of the LED lights 21 according to the light control signal. Specifically, when the hunting lamp is switched to the spotlight mode, the spotlight LED beads 211 light up; when the hunting lamp is switched to the floodlight mode, the floodlight LED beads 212 light up; and when the hunting lamp is switched to the warning light mode, the warning light LED beads 213 flash.

The light control signal may be a first light control signal, a second light control signal or a third light control signal, the first light control signal is used to control the spotlight mode, the second light control signal is used to control the floodlight mode, and the third light control signal is used to control the warning light mode. The three different modes are controlled by the three different light control signals, which avoids signal or logic confusion.

Figure 10:
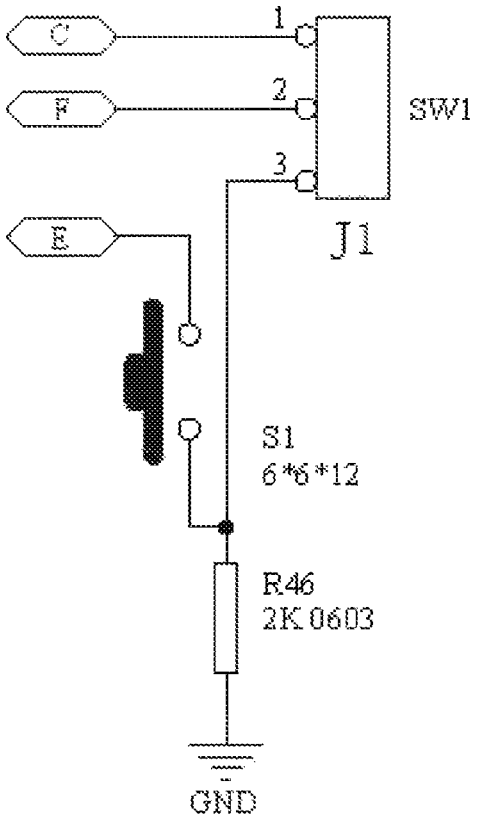
FIG. 10 is a diagram of a key switch circuit.
Figure 11:
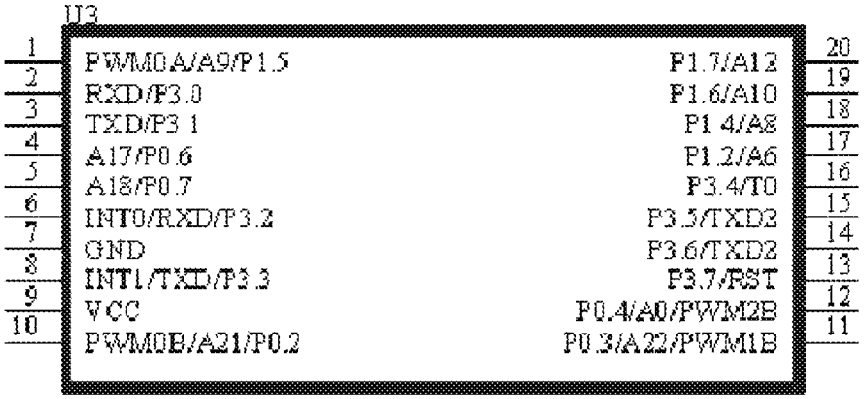
FIG. 11 is a diagram of a main control chip.

As shown in FIGS. 10 and 11, the main control chip comprises a first pin to a twentieth pin, and the key switch circuit comprises: a first key switch (S1), one end of the first key switch being grounded through a forty-sixth resistor (R46), and the other end being connected to the eleventh pin of the main control chip; and a first socket connector (J) comprising a first socket to a third socket, the first socket being connected to the fifteenth pin of the main control chip, the second socket being connected to the fourteenth pin of the main control chip, and the third socket being grounded through the forty-sixth resistor (R46).

Figure 12:
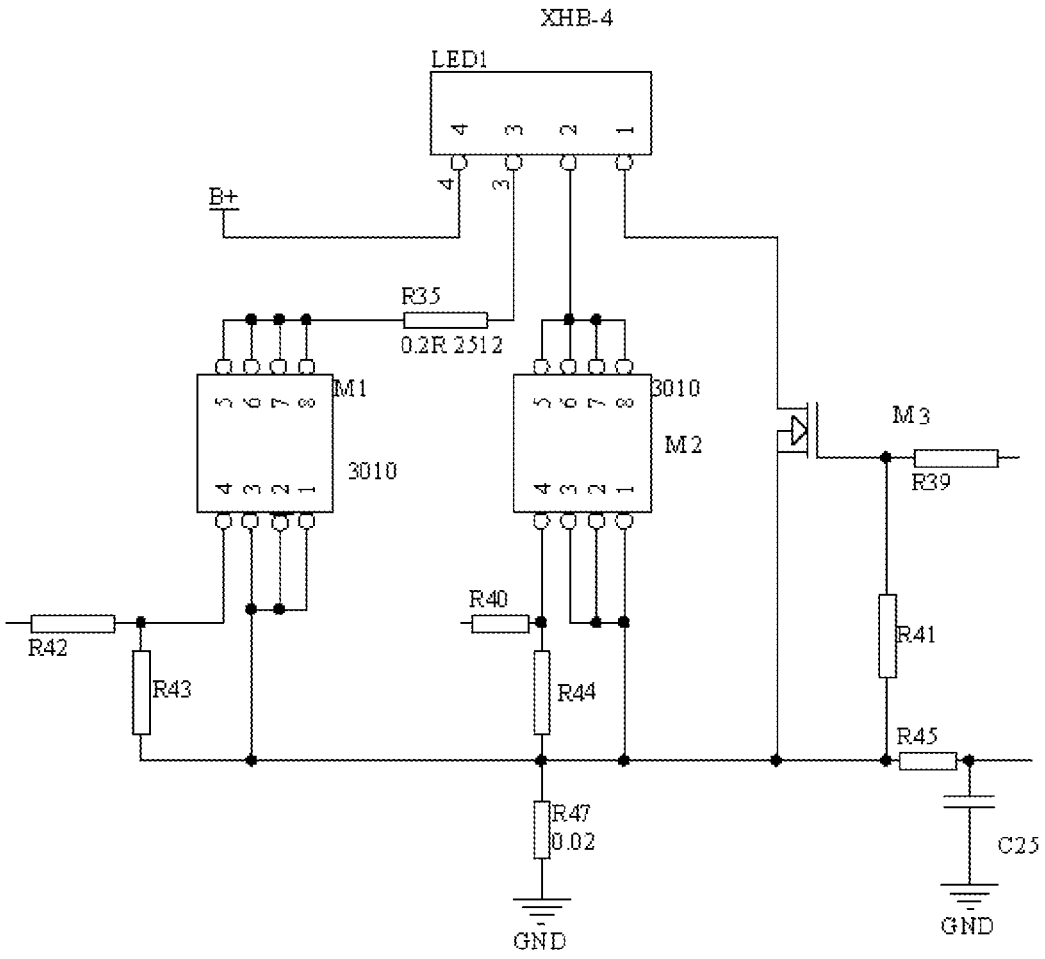
FIG. 12 is a diagram of a lamp panel drive circuit.

As shown in FIGS. 10-12, the lamp panel drive circuit comprises a first digital-to-analog conversion chip (M1) and a second digital-to-analog conversion chip (M2), the first digital-to-analog conversion chip (M1) and the second digital-to-analog conversion chip (M2) each comprise a first pin to an eighth pin, and the LED lights comprise a first socket to a fourth socket; the fourth pin of the first digital-to-analog conversion chip (M1) is connected to the first light control signal output by the nineteenth pin of the main control chip through a forty-second resistor (R42), and is grounded through a forty-third resistor (R43) and a forty-seventh resistor (R47) connected in sequence, the first pin to the third pin of the first digital-to-analog conversion chip (M1) are grounded through the forty-seventh resistor (R47), and the fifth pin to the eighth pin of the first digital-to-analog conversion chip (M1) are connected to the third socket of the LED lights through a thirty-fifth resistor (R35); the fourth pin of the second digital-to-analog conversion chip (M2) is connected to the second light control signal output by the twentieth pin of the main control chip through a fortieth resistor (R40), and is grounded through a forty-fourth resistor (R44) and the forty-seventh resistor (R47) connected in sequence, the first pin to the third pin of the second digital-to-analog conversion chip (M2) are grounded through the forty-seventh resistor (R47), and the fifth pin to the eighth pin of the second digital-to-analog conversion chip (M2) are connected to the second socket of the LED lights; and the fourth socket of the LED lights is connected to a working power supply. It should be noted that the LED lights in the embodiment can be powered by a rechargeable battery arranged inside, or directly powered by an external power supply. The first socket of the LED lights is connected to a drain of a first field effect transistor (FET) (M3), a source of the first FET is grounded, a gate of the first FET is connected to one end of a thirty-ninth resistor (39) and one end of a forty-first resistor (41), the other end of the thirty-ninth resistor (39) is connected to the tenth pin of the main control chip, the other end of the forty-first resistor (41) is grounded and connected to the first pin of the main control chip and one end of a twenty-fifth capacitor (C25) through a forty-fifth resistor (45), and the other end of the twenty-fifth capacitor (C25) is grounded.

Figure 13:
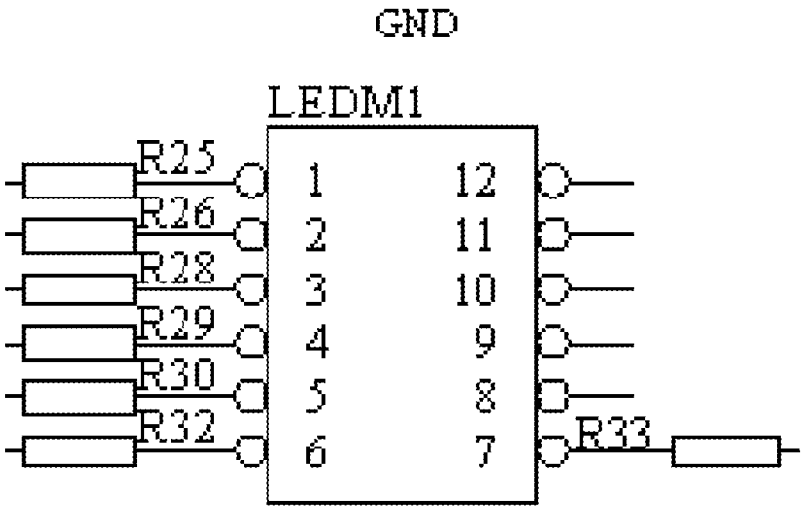
FIG. 13 is a diagram of digitron display.

As shown in FIG. 13, the control module further comprises a digitron, which comprises a first display tube to a sixth display tube, and a seventh pin to a twelfth pin, wherein the first display tube to the sixth display tube are configured to display the mode information of the hunting lamp, the seventh pin is connected to the sixth pin of the main control chip through a thirty-second resistor (R32), the ninth pin is connected to the thirteenth pin of the main control chip, the tenth pin is connected to the eighth pin of the main control chip, and the eleventh pin is connected to the fourth pin of the main control chip.

In actual use, the information flow between different parts of the control module is as follows: the key switch circuit in the control module outputs the switch signal to the main control chip according to the opening and closing conditions of the switch; after receiving the signal, the main control chip outputs the corresponding light control signal to the lamp panel drive circuit; and the lamp panel drive circuit adjusts the lighting mode of the LED lights according to the received light control signal, which allows the hunting lamp to be easily controlled to switch among the spotlight mode, the floodlight mode and the warning light mode.

In this scheme, the hunting lamp can switch among the spotlight mode, the floodlight mode and the warning light mode, which makes the hunting lamp convenient to use, high in safety performance and low in idle rate.

The specific embodiments described herein are only illustrative of the spirit of the invention. Those skilled in the art to which the invention belongs can make various modifications or supplements to the specific embodiments described or replace them in a similar way, without departing from the spirit of the invention or exceeding the scope defined by the appended claims.

What is claimed is:

1. A multi-mode hunting lamp, comprising:

a housing with a receiving chamber, the housing being provided with a handle and a first hinge part;

a lamp base provided with a second hinge part, the second hinge part being hinged to the first hinge part so that a lighting angle of the lamp base can be adjusted, and a plurality of LED lights being arranged in the lamp base; and a control module arranged in the receiving chamber and electrically connected to the LED lights;

wherein the hunting lamp has a spotlight mode, a floodlight mode and a warning light mode, and the control module can control the hunting lamp to switch among the spotlight mode, the floodlight mode and the warning light mode;

the plurality of LED lights comprise spotlight LED beads, floodlight LED beads and warning light LED beads, which are all electrically connected to the control module;

the control module comprises a key switch circuit, a main control chip and a lamp panel drive circuit, and the key switch circuit is configured to output a switch signal to the main control chip according to the opening and closing of keys;

the main control chip is configured to output a corresponding light control signal to the lamp panel drive circuit according to the received switch signal;

the lamp panel drive circuit is configured to adjust a lighting mode of the LED lights according to the light control signal;

when the hunting lamp is switched to the spotlight mode, the spotlight LED beads light up; when the hunting lamp is switched to the floodlight mode, the floodlight LED beads light up; and when the hunting lamp is switched to the warning light mode, the warning light LED beads flash.

2. The multi-mode hunting lamp according to claim 1, wherein the light control signal may be a first light control signal, a second light control signal or a third light control signal, the first light control signal is used to control the spotlight mode, the second light control signal is used to control the floodlight mode, and the third light control signal is used to control the warning light mode.

3. The multi-mode hunting lamp according to claim 2, wherein the main control chip comprises a first pin to a twentieth pin, and the key switch circuit comprises:

a first key switch, one end of the first key switch being grounded through a forty-sixth resistor, and the other end being connected to the eleventh pin of the main control chip; and a first socket connector comprising a first socket to a third socket, the first socket being connected to the fifteenth pin of the main control chip, the second socket being connected to the fourteenth pin of the main control chip, and the third socket being grounded through the forty-sixth resistor.

4. The multi-mode hunting lamp according to claim 3, wherein the lamp panel drive circuit comprises a first digital-to-analog conversion chip and a second digital-to-analog conversion chip, the first digital-to-analog conversion chip and the second digital-to-analog conversion chip each comprise a first pin to an eighth pin, and the LED lights comprise a first socket to a fourth socket;

the fourth pin of the first digital-to-analog conversion chip is connected to the first light control signal output by the nineteenth pin of the main control chip through a forty-second resistor, and is grounded through a forty-third resistor and a forty-seventh resistor connected in sequence, the first pin to the third pin of the first digital-to-analog conversion chip are grounded through the forty-seventh resistor, and the fifth pin to the eighth pin of the first digital-to-analog conversion chip are connected to the third socket of the LED lights through a thirty-fifth resistor;

the fourth pin of the second digital-to-analog conversion chip is connected to the second light control signal output by the twentieth pin of the main control chip through a fortieth resistor, and is grounded through a forty-fourth resistor and the forty-seventh resistor connected in sequence, the first pin to the third pin of the second digital-to-analog conversion chip are grounded through the forty-seventh resistor, and the fifth pin to the eighth pin of the second digital-to-analog conversion chip are connected to the second socket of the LED lights; and the fourth socket of the LED lights is connected to a working power supply, the first socket of the LED lights is connected to a drain of a first field effect transistor (FET), a source of the first FET is grounded, a gate of the first FET is connected to one end of a thirty-ninth resistor and one end of a forty-first resistor, the other end of the thirty-ninth resistor is connected to the tenth pin of the main control chip, the other end of the forty-first resistor is grounded and connected to the first pin of the main control chip and one end of a twenty-fifth capacitor through a forty-fifth resistor, and the other end of the twenty-fifth capacitor is grounded.

5. The multi-mode hunting lamp according to claim 1, wherein the second hinge part extends from a top of the lamp base towards the housing, a through hole is formed in the second hinge part, the first hinge part is arranged at the top of the housing, the first hinge part is provided with an installation groove in which a rotating shaft is arranged, the second hinge part is arranged in the installation groove, and the rotating shaft penetrates through the through hole; and two fixture blocks are arranged on the housing along two sides of the second hinge part respectively, and the second hinge part is rotatably arranged between the two fixture blocks.

6. The multi-mode hunting lamp according to claim 1, wherein a bottom of the housing is provided with a first placement part, an end of the housing away from the lamp base is provided with a second placement part, and the hunting lamp can be placed in a horizontal state or a vertical state;

when the hunting lamp is placed in the horizontal state, the first placement part supports the whole hunting lamp; and when the hunting lamp is placed in the vertical state, the second placement part supports the whole hunting lamp.

7. The multi-mode hunting lamp according to claim 6, wherein a circular flange is arranged on the bottom of the housing in a downward protruding mode, the first placement part is arranged on the flange in a protruding mode, an end cap is arranged at an end of the housing away from the lamp base, the second placement part is arranged at an end of the end cap away from the lamp base along its own circumference in a protruding mode, and the second placement part is perpendicular to the first placement part.

8. The multi-mode hunting lamp according to claim 1, further comprising a strap, wherein one end of the strap is connected to a first loop, the other end of the strap is connected to a second loop, the first loop is rotatably connected to the lamp base, and the second loop is rotatably connected to a rear end of the housing.

9. The multi-mode hunting lamp according to claim 8, wherein the first loop and the second loop each comprise a first hinge arm, a second hinge arm and a joint arm, the first hinge arm and the second hinge arm are spaced apart, the joint arm is connected to one end of the first hinge arm and one end of the second hinge arm, and the other end of the first hinge arm and the other end of the second hinge arm are hinged to the housing or the lamp base.

* * * * *